US010157576B2

(12) United States Patent
Feng

(10) Patent No.: US 10,157,576 B2
(45) Date of Patent: Dec. 18, 2018

(54) PIXEL DRIVING CIRCUIT, DRIVING METHOD FOR SAME, AND DISPLAY APPARATUS

(71) Applicants: Boe Technology Group Co., Ltd., Beijing (CN); Chengdu Boe Optoelectronics Technology Co., Ltd., Chengdu, Sichuan Province (CN)

(72) Inventor: Yuhsiung Feng, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 0 days.

(21) Appl. No.: 15/558,537

(22) PCT Filed: Apr. 1, 2017

(86) PCT No.: PCT/CN2017/079241

§ 371 (c)(1),
(2) Date: Sep. 14, 2017

(87) PCT Pub. No.: WO2018/049809

PCT Pub. Date: Mar. 22, 2018

(65) Prior Publication Data

US 2018/0247595 A1 Aug. 30, 2018

(30) Foreign Application Priority Data

Sep. 19, 2016 (CN) ..... 2016 1 0830007

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01)

(58) Field of Classification Search
CPC ... G09G 3/3266; G09G 3/3258; G09G 3/3233
See application file for complete search history.

(56) References Cited

U.S. PATENT DOCUMENTS

2014/0055325 A1 2/2014 Qi et al.
2014/0118328 A1 5/2014 Guo et al.
(Continued)

FOREIGN PATENT DOCUMENTS

CN 102708792 A 10/2012
CN 103971640 A 8/2014
(Continued)

OTHER PUBLICATIONS

International Search Report and Written Opinion in PCT/CN2017/079241 dated Jun. 29, 2017, with English translation.

*Primary Examiner* — Abhishek Sarma
(74) *Attorney, Agent, or Firm* — Womble Bond Dickinson (US) LLP

(57) ABSTRACT

A pixel driving circuit and a driving method thereof, as well as a display apparatus. The driving circuit is realized by using one storage capacitor, one driving unit and five switching units, which may obtain a smaller pixel layout and facilitate improvement of display resolution. Also, a display effect of the pixels in a dark state may be improved, and the contrast be increased.

20 Claims, 5 Drawing Sheets

(56) References Cited

U.S. PATENT DOCUMENTS

| | | | | |
|---|---|---|---|---|
| 2017/0039942 | A1 | 2/2017 | Han | |
| 2017/0047002 | A1 | 2/2017 | Xuan et al. | |
| 2017/0330511 | A1* | 11/2017 | Feng | G09G 3/3233 |

FOREIGN PATENT DOCUMENTS

| | | | |
|---|---|---|---|
| CN | 104700778 | A | 6/2015 |
| CN | 105161051 | A | 12/2015 |
| CN | 106128365 | A | 11/2016 |

* cited by examiner

PIXEL DRIVING CIRCUIT, DRIVING METHOD FOR SAME, AND DISPLAY APPARATUS

RELATED APPLICATIONS

This application is the U.S. national phase entry of PCT/CN2017/079241, with an international filing date of Apr. 1, 2017, which claims the benefit of the priority of Chinese patent application No. 201610830007.5 filed on Sep. 19, 2016, the entire disclosures of which are incorporated herein by reference.

TECHNICAL FIELD

The present disclosure relates to the field of display technology, and particularly to a pixel driving circuit and its driving method, as well as a display apparatus.

BACKGROUND

Active matrix organic light-emitting diode (AMOLED) displays are among the hot spots in today's flat panel display research. The organic light-emitting diode (OLED) has advantages such as low energy consumption, low production cost, being self-luminous, a wide viewing angle and a fast response speed, as compared with the liquid crystal display (LCD). At present, OLED displays are starting to replace traditional LCD displays in the fields of mobile phone, personal digital assistant (PDA), digital camera and the like. Pixel driving circuit design is the core technology of an AMOLED display, and is of important research significance.

Unlike thin film transistor liquid crystal displays (TFT-LCDs) which use a stable voltage for brightness control, the OLED display requires a steady current to control the light emission since the OLED is a current-driven type of device. In the existing driving circuit with two transistors 10, 20 and one storage capacitor C (referring to FIG. 1), the driving current $I_{OLED}$ is a current generated by applying a voltage Vdata provided by a data line to the driving transistor 20 operating in a saturation region, which current drives the OLED to emit light. The driving current is calculated as $I_{OLED}=K(V_{GS}-Vth)^2$, where $V_{GS}$ is a voltage across the gate and the source of the driving transistor, and Vth is a threshold voltage of the driving transistor. There is non-uniformity among the threshold voltages Vth of the driving TFTs (i.e., 20 in the figure) of the pixels due to the fabrication process and the aging of the devices. This leads to a variation among the currents flowing through the OLEDs of individual pixels, thus affecting the display effect of the entire image.

SUMMARY

Embodiments of the present disclosure provide a pixel driving circuit and a driving method thereof, as well as a display apparatus, which may avoid an influence of a threshold voltage drift of the driving unit on the driving current of the active light emitting device, thereby resulting in improvement of the uniformity of the display image, improvement of the display effect of the pixels in a dark state, and an increase in the display contrast.

According to an aspect of the present disclosure, a pixel driving circuit is provided in an embodiment of the disclosure which comprises a light emitting device, a storage capacitor, a driving unit and first to fifth switching units. Each of the switching units comprises a control terminal, a first signal terminal and a second signal terminal, and the control terminal of the switching unit is operable to bring the first and second signal terminals into or out of conduction. The driving unit comprises a control terminal, a signal input terminal and a drive terminal. The control terminal and the signal input terminal of the driving unit are operable to control a drive signal outputted at the drive terminal. The control terminal of the driving unit is connected with a first terminal of the storage capacitor, the first signal terminal of the first switching unit, the first signal terminal of the second switching unit and the control terminal of the third switching unit. The control terminal of the first switching unit is operable to input a reset signal, and the second signal terminal of the first switching unit being connected with an initialization voltage. The control terminal of the second switching unit is operable to input a scan signal, and the second signal terminal of the second switching unit is connected with the first signal terminal of the third switching unit. The second signal terminal of the third switching unit being operable to input a data signal. The control terminal of the fourth switching unit is operable to input a light emitting signal. The control terminal of the fifth switching unit is operable to input the reset signal, the first signal terminal of the fifth switching unit is connected with the initialization voltage, and the second signal terminal of the fifth switching unit is connected with a first terminal of the light emitting device. The signal input terminal of the driving unit is connected with a second terminal of the storage capacitor and a first voltage, the drive terminal of the driving unit is connected with the first signal terminal of the fourth switching unit, and the second signal terminal of the fourth switching unit is connected with the first terminal of the light emitting device. Alternatively, the first signal terminal of the fourth switching unit is connected with the second terminal of the storage capacitor and the first voltage, the second signal terminal of the fourth switching unit is connected with the signal input terminal of the driving unit, and the drive terminal of the driving unit is connected with the first terminal of the light emitting device. A second terminal of the light emitting device is connected with a second voltage.

In the pixel driving circuit provided in the embodiments of the present disclosure, the control terminal of the driving unit is connected to the first terminal of the storage capacitor, the first signal terminal of the first switching unit, the first signal terminal of the second switching unit, and the control terminal of the third switching unit. The control terminal of the first switching unit is used for inputting a reset signal, and the second signal terminal of the first switching unit is connected with the initialization voltage. The control terminal of the second switching unit is used for inputting a scan signal, and the second signal terminal of the second switching unit is connected with the first signal terminal of the third switching unit. The second signal terminal of the third switching unit is used for inputting a data signal. The control terminal of the fourth switching unit is used for inputting a light emitting signal. The control terminal of the fifth switching unit is used for inputting a reset signal, the first signal terminal of the fifth switching unit is connected with an initialization voltage, and the second signal terminal of the fifth switching unit is connected with the first terminal of the light emitting device. With the pixel driving circuit provided in the embodiments of the present disclosure, a sum of the data signal voltage and the threshold voltage of the third switching unit can be written into the control terminal of the driving unit before the light emitting device emits light, thereby eliminating the effect of the change in the threshold voltage of the driving unit on the light emission. Moreover, a circuit configuration can be achieved with a relatively small storage capacitor. Furthermore, the first terminal of the light emitting device can be initialized with the fifth switch unit so that a voltage across the light emitting device can be adjusted to, for example, zero before light emission. The leakage current generated by the driving unit may flow out through the first signal terminal of the fifth switching unit when a dark state display with lower gray scales is performed. Therefore, the leakage current does not flow to the light emitting device so that the light emitting device can accurately show the dark state, thereby increasing the display contrast. The embodiments of the present disclosure may implement a driving circuit by using one storage capacitor, one driving unit and five switching units, which may obtain a smaller pixel layout and contribute to improvement of the display resolution. Moreover, the display effect of the pixels in the dark state can be improved, and the contrast be increased.

Optionally, the driving unit and the first to fifth switching units are thin film transistors. The control terminal of each of the switching units and the control terminal of the driving unit are each a gate of the thin film transistor. The first signal terminal and the second signal terminal of each of the switching units are a source and a drain of the thin film transistor, respectively. Alternatively, the first signal terminal and the second signal terminal of each of the switching units are a drain and a source of the thin film transistor, respectively. The signal input terminal and the drive terminal of the driving unit are a source and a drain of the thin film transistor, respectively; or the signal input terminal and the drive terminal of the driving unit are a drain and a source of the thin film transistor, respectively.

With the pixel driving circuit provided in the embodiments of the present disclosure, a sum of the data signal voltage and the threshold voltage of the third switching unit can be written into the gate of the thin film transistor that serves as the driving unit, thereby eliminating the effect of the change in the threshold voltage of the thin film transistor that serves as the driving unit on the light emission. Moreover, a circuit configuration can be achieved with a relatively small storage capacitor. The embodiments of the present disclosure implement a driving circuit by using one storage capacitor and six thin film transistors, which may obtain a smaller pixel layout and contribute to improvement of the display resolution.

Optionally, the driving unit and the first to fifth switching units are P-type thin film transistors. Alternatively, the driving unit and the first to fifth switching units are N-type thin film transistors.

The switch unit and the driving unit employed in embodiments of the present disclosure may be thin film transistors or field effect transistors or other devices having the same characteristics. Being symmetrical, the source and drain of the thin film transistor are interchangeable. In embodiments of the present disclosure, in order to distinguish between the two electrodes of the thin film transistor other than its gate, one of them is referred to as a source, and the other as a drain. According to the configurations in the figures, the middle terminal of the thin film transistor is the gate, the signal input terminal is the source, and the signal output terminal is the drain. The P-type thin film transistor is turned on when the gate is at a low voltage and is turned off when the gate is at a high voltage. The N-type thin film transistor is turned on when the gate is a high voltage and is turned off when the gate is at a low voltage. The P-type thin film transistor that serves as the driving unit is in an amplified state or a saturated state when the gate voltage is a low voltage (the gate voltage is smaller than the source voltage) and the absolute value of the voltage difference between the gate and the source is larger than the threshold voltage. The N-type thin film transistor that serves as the driving unit is in an amplified state or a saturated state when the gate voltage is a high voltage (the gate voltage is larger than the source voltage) and the absolute value of the voltage difference between the gate and the source is larger than the threshold voltage.

Optionally, the driving unit and the third switching unit are thin film transistors having the same specifications.

The threshold voltages of thin film transistors having the same specifications have the same tendency to vary. That is, the threshold voltage Vth3 of the thin film transistor that serves as the third switching unit is substantially equal to the threshold voltage Vthd of the thin film transistor that serves as the driving unit. Therefore, the thin film transistor serving as the third switching unit can write the sum of the data line voltage and its threshold voltage (Vdata+Vth3) to the first terminal of the storage capacitor, thereby eliminating the influence of the threshold voltage Vthd of the driving unit on the driving current.

Optionally, the light emitting device is an organic light emitting diode.

According to another aspect of the present disclosure, a display substrate is provided in an embodiment of the disclosure which comprises the pixel driving circuit as described the above embodiments.

According to yet another aspect of the present disclosure, a display apparatus is provided in an embodiment of the disclosure which comprises the pixel driving circuit as described the above embodiments.

According to yet another aspect of the present disclosure, a driving method for the pixel driving circuit as described above is provided in an embodiment of the disclosure. The driving method comprises: a first phase in which the first signal terminal and the second signal terminal of the first switching unit are brought into conduction, the storage capacitor is charged with the initialization voltage, the first signal terminal and the second signal terminal of the fifth switching unit are brought into conduction, and the first terminal of the light emitting device is initialized with the initialization voltage; a second phase in which the first signal terminal and the second signal terminal of the second switching unit are brought into conduction, and the storage capacitor is charged via the second signal terminal and the control terminal of the third switching unit with the data signal; and a third phase in which a first signal terminal and the second signal terminal of the fourth switching unit are brought into conduction, and the light emitting device is driven by the driving unit.

With the driving method of the pixel driving circuit provided in the embodiment of the present disclosure, a sum of the data signal voltage and the threshold voltage of the third switching unit can be written into the control terminal of the driving unit before the light emitting device emits light, thereby eliminating the effect of the change in the threshold voltage of the driving unit on the light emission. Moreover, a circuit configuration can be achieved with a relatively small storage capacitor. Furthermore, the first terminal of the light emitting device can be initialized with the fifth switch unit so that a voltage across the light emitting device can be adjusted to, for example, zero before light emission. The leakage current generated by the driving unit may flow out through the first signal terminal of the fifth switching unit when a dark state display with lower gray scales is performed. Therefore, the leakage current does not flow to the light emitting device so that the light emitting device can accurately show the dark state, thereby increasing the display contrast. The embodiments of the present disclosure may implement a driving circuit by using one storage capacitor, one driving unit and five switching units, which may obtain a smaller pixel layout and contribute to improvement of the display resolution. Moreover, the display effect of the pixels in the dark state can be improved, and the contrast be increased.

Optionally, the driving unit is a thin film transistor, and the thin film transistor serving as the driving unit is in a saturated state in the third phase.

When the thin film transistor used as the driving unit is in a saturated state, its output current is:

$$I_{OLED}=\tfrac{1}{2}\beta[V_{GS}-Vthd]^2=\tfrac{1}{2}\beta[VDD-V\text{data}+Vth3-Vthd]^2=\tfrac{1}{2}\beta[VDD-V\text{data}]^2$$

As can be seen from the above formula, the driving current $I_{OLED}$ is related only to the data signal voltage Vdata, so that the driving current is not affected by the threshold voltage Vthd of the thin film transistor serving as the driving unit. $V_{GS}$ is the voltage between the gate and the source of the thin film transistor, $\beta=\mu C_{ox}W/L$, μ and Cox are process constants, W is the channel width of the thin film transistor, L is the channel length of the thin film transistor, and W, L are constants that are selectively designed. In this case, since the Vth3≈Vthd, the current on the light emitting device OLED is independent of the threshold voltage Vthd of the thin film transistor serving as the driving unit.

With the pixel driving circuit provided in the embodiments of the present disclosure, the sum of the data signal voltage and the threshold voltage of the third switching unit can be written into the control terminal of the driving unit before the light emitting device emits light, thereby eliminating the effect of the change in the threshold voltage of the driving unit on the light emission. Moreover, a circuit configuration can be achieved with a relatively small storage capacitor. The embodiments of the present disclosure may implement a driving circuit by using one storage capacitor, one driving unit and five switching units, which may obtain a smaller pixel layout and contribute to improvement of the display resolution.

DETAILED DESCRIPTION

Embodiments of the present disclosure will be described clearly and completely below in conjunction with the accompanying drawings in the present disclosure. It will be apparent that the described embodiments are merely part of the embodiments and not all of the embodiments of the present disclosure. All other embodiments derived from the embodiments of the present disclosure by those of ordinary skill in the art without making any inventive effort are within the scope of the present disclosure.

Figure 1:
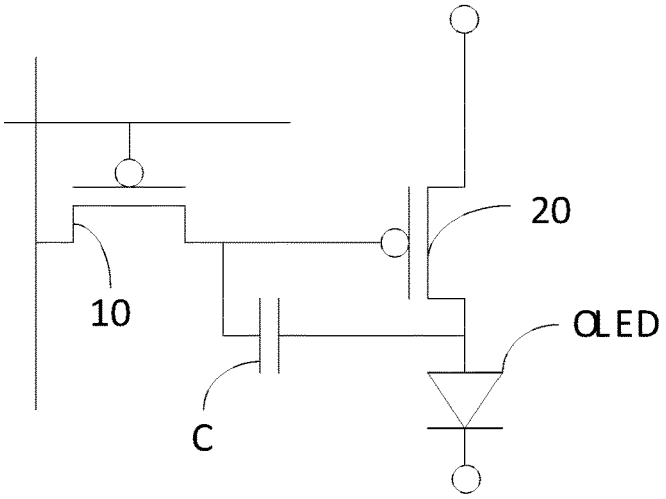
(PRIOR ART) FIG. 1
FIG. 1 shows a structural schematic diagram of a prior art pixel driving circuit.
Figure 2:
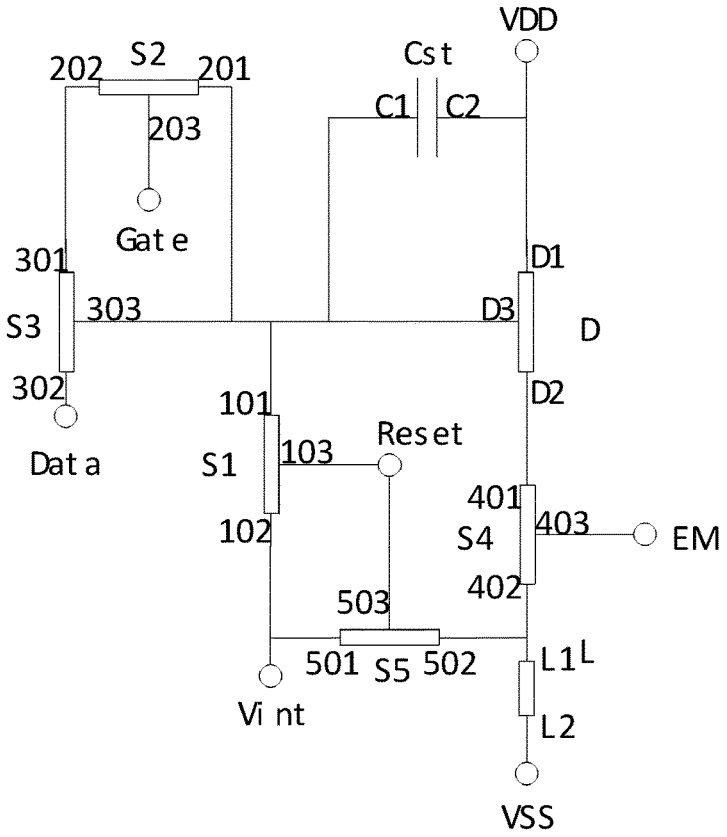
FIG. 2 shows a structural schematic diagram of a pixel driving circuit provided in an embodiment of the present disclosure.

As shown in FIG. 2, according to an aspect of the present disclosure, an embodiment of the present disclosure provides a pixel driving circuit. The pixel driving circuit includes a light emitting device L, a storage capacitor Cst, a driving unit D, and five switching units S1, S2, S3, S4 and S5. Each of the switching units includes a control terminal, a first signal terminal and a second signal terminal. The control terminal of the switching unit is used to bring the first and second signal terminals into or out of conduction. The driving unit D comprises a control terminal D3, a signal input terminal D1 and a drive terminal D2. The control terminal D3 and the signal input terminal D1 of the driving unit D are used to control a drive signal outputted at the drive terminal D2. The control terminal D3 of the driving unit D is connected to a first terminal C1 of the storage capacitor Cst, the first signal terminal 101 of a first switch unit S1, the first signal terminal 201 of a second switching unit S2, and the control terminal 303 of a third switching unit S3. The control terminal 103 of the first switching unit S1 is used to input a reset signal "Reset". The second signal terminal 102 of the first switching unit S1 is connected to an initialization voltage Vint. The control terminal 203 of the second switching unit S2 is used to input a scan signal "Gate". The second signal terminal 202 of the second switching unit S2 is connected with the first signal terminal 301 of the third switch unit S3. The second signal terminal 302 of the third switching unit S3 is used to input a data signal "Data". The control terminal 403 of a fourth switching unit S4 is used to input a light emitting signal EM. The control terminal 503 of the fifth switching unit S5 is used to input the reset signal "Reset". The first signal terminal 501 of a fifth switching unit S5 is connected to the initialization voltage Vint. The second signal terminal 502 of the fifth switching unit S5 is connected to a first terminal L1 of the light emitting device L. The signal input terminal D1 of the driving unit D is connected to a second terminal C2 of the storage capacitor Cst and a first voltage VDD. The drive terminal D2 of the driving unit D is connected to the first signal terminal 401 of the fourth switching unit S4. The second signal terminal 402 of the fourth switching unit S4 is connected to the first terminal L1 of the light emitting device L. A second terminal L2 of the light emitting device L is connected to a second voltage VSS.

Figure 4:
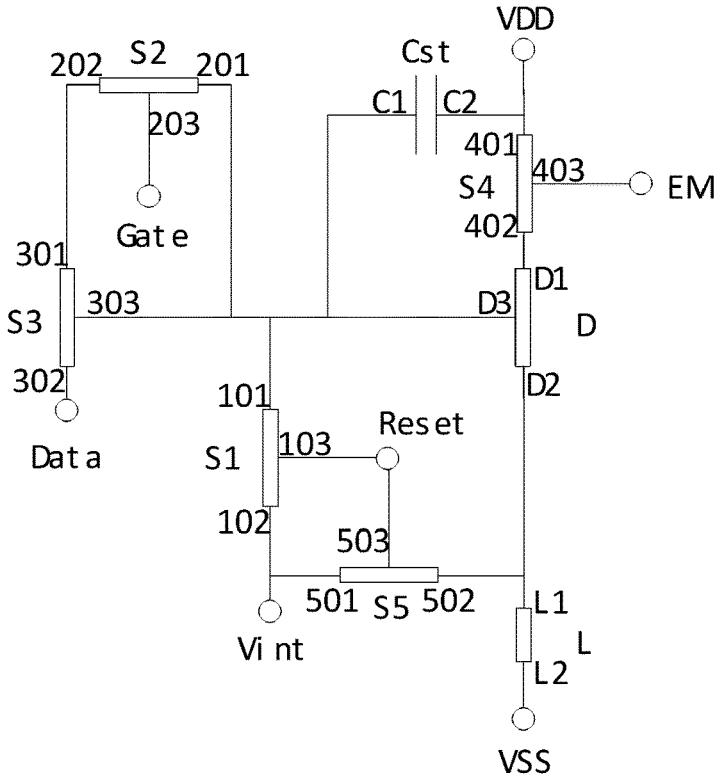
FIG. 4 shows a structural schematic diagram of a pixel driving circuit provided in yet another embodiment of the present disclosure.

Alternatively, as shown in FIG. 4, the first signal terminal 401 of the fourth switching unit S4 is connected to the second terminal C2 of the storage capacitor Cst and the first voltage VDD, the second signal terminal 402 of the fourth switch unit S4 is connected to the signal input terminal D1 of the driving unit D, and the driving terminal D2 of the driving unit D is connected to the first terminal L1 of the light emitting device L.

In the pixel driving circuit provided in the embodiments of the present disclosure, the control terminal of the driving unit is connected to the first terminal of the storage capacitor, the first signal terminal of the first switching unit, the first signal terminal of the second switching unit, and the control terminal of the third switching unit. The control terminal of the first switching unit is used for inputting a reset signal, and the second signal terminal of the first switching unit is connected with the initialization voltage. The control terminal of the second switching unit is used for inputting a scan signal, and the second signal terminal of the second switching unit is connected with the first signal terminal of the third switching unit. The second signal terminal of the third switching unit is used for inputting a data signal. The control terminal of the fourth switching unit is used for inputting a light emitting signal. The control terminal of the fifth switching unit is used for inputting a reset signal, the first signal terminal of the fifth switching unit is connected with an initialization voltage, and the second signal terminal of the fifth switching unit is connected with the first terminal of the light emitting device. With the pixel driving circuit provided in the embodiments of the present disclosure, a sum of the data signal voltage and the threshold voltage of the third switching unit can be written into the control terminal of the driving unit before the light emitting device emits light, thereby eliminating the effect of the change in the threshold voltage of the driving unit on the light emission. Moreover, a circuit configuration can be achieved with a relatively small storage capacitor. Furthermore, the first terminal of the light emitting device can be initialized with the fifth switch unit so that a voltage across the light emitting device can be adjusted to, for example, zero before light emission. The leakage current generated by the driving unit may flow out through the first signal terminal of the fifth switching unit when a dark state display with lower gray scales is performed. Therefore, the leakage current does not flow to the light emitting device so that the light emitting device can accurately show the dark state, thereby increasing the display contrast. The embodiments of the present disclosure may implement a driving circuit by using one storage capacitor, one driving unit and five switching units, which may obtain a smaller pixel layout and contribute to improvement of the display resolution. Moreover, the display effect of the pixels in the dark state can be improved, and the contrast be increased.

Figure 3:
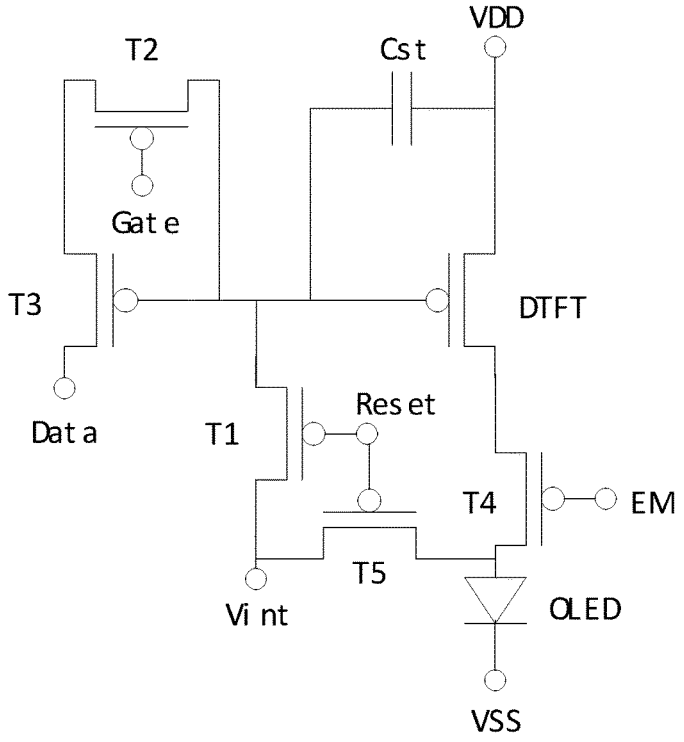
FIG. 3 shows a structural schematic diagram of a pixel driving circuit provided in another embodiment of the present disclosure.
Figure 5:
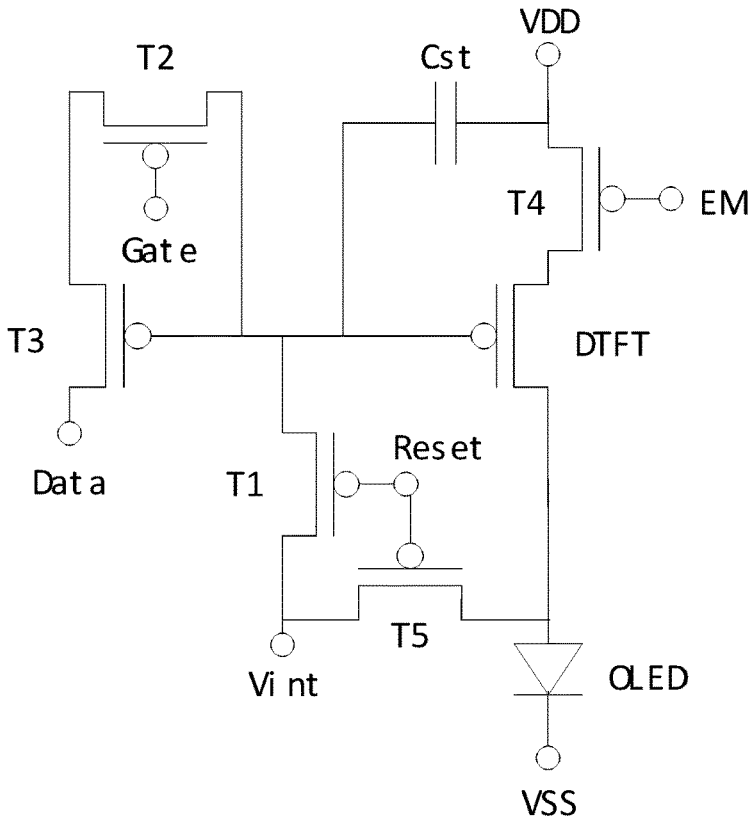
FIG. 5 shows a structural schematic diagram of a pixel driving circuit provided in a further embodiment of the present disclosure.

Optionally, as shown in FIGS. 3 and 5, the light emitting device may be an organic light emitting diode OLED, the driving unit DTFT and the five switching units T1, T2, T3, T4 and T5 are thin film transistors, with the control terminals of each switching unit and the driving unit being the gates of the thin film transistors. The first signal terminal and the second signal terminal of each switching unit are the source and the drain of the thin film transistor, respectively. Alternatively, the first signal terminal and the second signal terminal of each switching unit are the drain and the source of the thin film transistor, respectively. The signal input terminal and the drive terminal of the driving unit DTFT are the source and the drain of the thin film transistor, respectively. Alternatively, the signal input terminal and the drive terminal of the driving unit DTFT are the drain and the source of the thin film transistor, respectively.

With the pixel driving circuit provided in the embodiments of the present disclosure, a sum of the data signal voltage Vdata and the threshold voltage Vth3 of the third switching unit T3 can be written into the gate of the thin film transistor that serves as the driving unit DTFT, thereby eliminating the effect of the change in the threshold voltage of the thin film transistor that serves as the driving unit on the light emission. Moreover, a circuit configuration can be achieved with a relatively small storage capacitor. The embodiments of the present disclosure implement a driving circuit by using one storage capacitor and six thin film transistors, which may obtain a smaller pixel layout and contribute to improvement of the display resolution.

Optionally, both the driving unit and the five switching units are P-type thin film transistors. Alternatively, the driving unit and the five switching units are N-type thin film transistors.

The switch unit and the driving unit employed in embodiments of the present disclosure may be thin film transistors or field effect transistors or other devices having the same characteristics. Being symmetrical, the source and drain of the thin film transistor are interchangeable. In embodiments of the present disclosure, in order to distinguish between the two electrodes of the thin film transistor other than its gate, one of them is referred to as a source, and the other as a drain. According to the configurations in the figures, the middle terminal of the thin film transistor is the gate, the signal input terminal is the source, and the signal output terminal is the drain. The P-type thin film transistor is turned on when the gate is at a low voltage and is turned off when the gate is at a high voltage. The N-type thin film transistor is turned on when the gate is a high voltage and is turned off when the gate is at a low voltage. The P-type thin film transistor that serves as the driving unit is in an amplified state or a saturated state when the gate voltage is a low voltage (the gate voltage is smaller than the source voltage) and the absolute value of the voltage difference between the gate and the source is larger than the threshold voltage. The N-type thin film transistor that serves as the driving unit is in an amplified state or a saturated state when the gate voltage is a high voltage (the gate voltage is larger than the source voltage) and the absolute value of the voltage difference between the gate and the source is larger than the threshold voltage.

Optionally, the driving unit DTFT and the third switch unit T3 are thin film transistors having the same specifications.

The threshold voltages of thin film transistors having the same specifications have the same tendency to vary. That is, the threshold voltage Vth3 of the thin film transistor that serves as the third switching unit is substantially equal to the threshold voltage Vthd of the thin film transistor that serves as the driving unit. Therefore, the thin film transistor serving as the third switching unit can write the sum of the data line voltage and its threshold voltage (Vdata+Vth3) to the first terminal of the storage capacitor, thereby eliminating the influence of the threshold voltage Vthd of the driving unit on the driving current.

Figure 6:
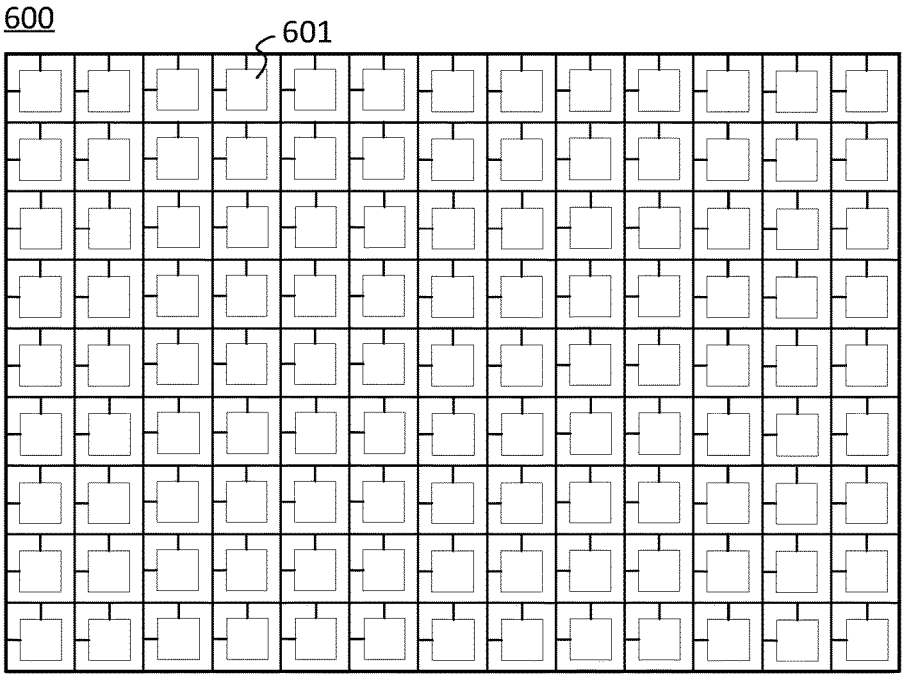
FIG. 6 shows a structural schematic diagram of a display substrate provided in an embodiment of the present disclosure.

According to another aspect of the present disclosure, an embodiment of the present disclosure further provides a display substrate. As shown in FIG. 6, the display substrate 600 includes a pixel driving circuit 601 as described in the above embodiments. Of course, the display substrate 600 may further include a base substrate for supporting the pixel driving circuit, gate lines, data lines, and the like, which are not limited here.

Figure 7:
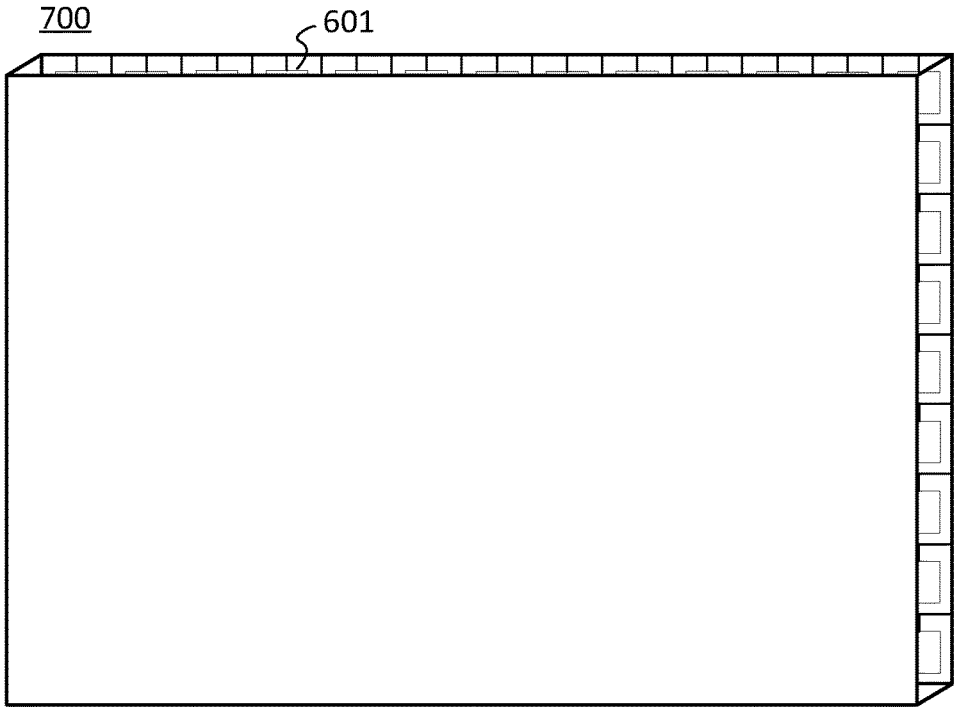
FIG. 7 shows a structural schematic diagram of a display apparatus provided in an embodiment of the present disclosure.

According to yet another aspect of the present disclosure, an embodiment of the present disclosure provides a display apparatus. As shown in FIG. 7, the display apparatus 700 includes the pixel driving circuit as described in the above embodiment.

Figure 8:
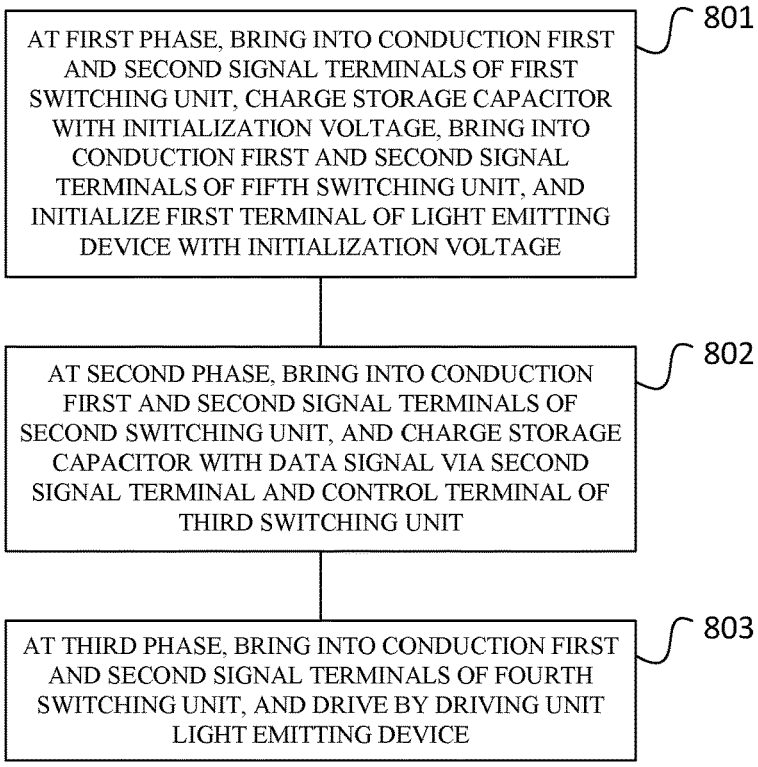
FIG. 8 shows a flow chart of a driving method of a pixel driving circuit provided in an embodiment of the present disclosure.

According to another aspect of the present disclosure, an embodiment of the present disclosure provides a driving method for the pixel driving circuit described above. As shown in FIG. 8, the driving method includes a first phase 801 in which the first signal terminal and the second signal terminal of the first switching unit are brought into conduction, the storage capacitor is charged with the initialization voltage, the first signal terminal and the second signal terminal of the fifth switching unit are brought into conduction, and the first terminal of the light emitting device is initialized with the initialization voltage, a second phase 802 in which the first signal terminal and the second signal terminal of the second switching unit are brought into conduction, and the storage capacitor is charged via the second signal terminal and the control terminal of the third switching unit with the data signal, and a third phase 803 in which a first signal terminal and the second signal terminal of the fourth switching unit are brought into conduction, and the light emitting device is driven by the driving unit.

With the driving method of the pixel driving circuit provided in the embodiment of the present disclosure, a sum of the data signal voltage and the threshold voltage of the third switching unit can be written into the control terminal of the driving unit before the light emitting device emits light, thereby eliminating the effect of the change in the threshold voltage of the driving unit on the light emission. Moreover, a circuit configuration can be achieved with a relatively small storage capacitor. Furthermore, the first terminal of the light emitting device can be initialized with the fifth switch unit so that a voltage across the light emitting device can be adjusted to, for example, zero before light emission. The leakage current generated by the driving unit may flow out through the first signal terminal of the fifth switching unit when a dark state display with lower gray scales is performed. Therefore, the leakage current does not flow to the light emitting device so that the light emitting device can accurately show the dark state, thereby increasing the display contrast. The embodiments of the present disclosure may implement a driving circuit by using one storage capacitor, one driving unit and five switching units, which may obtain a smaller pixel layout and contribute to improvement of the display resolution. Moreover, the display effect of the pixels in the dark state can be improved, and the contrast be increased.

Optionally, the driving unit is a thin film transistor, and the thin film transistor serving as the driving unit is in a saturated state in the third phase.

When the thin film transistor used as the driving unit is in a saturated state, its output current is:

$$I_{OLED}=\tfrac{1}{2}\beta[V_{GS}-Vthd]^2=\tfrac{1}{2}\beta[VDD-V\text{data}+Vth3-Vthd]^2=\tfrac{1}{2}\beta[VDD-V\text{data}]^2$$

As can be seen from the above formula, the driving current $I_{OLED}$ is related only to the data signal voltage Vdata, so that the driving current is not affected by the threshold voltage Vthd of the thin film transistor serving as the driving unit. $V_{GS}$ is the voltage between the gate and the source of the thin film transistor, $\beta=\mu C_{ox}W/L$, μ and Cox are process constants, W is the channel width of the thin film transistor, L is the channel length of the thin film transistor, and W, L are constants that are selectively designed. In this case, since the Vth3≈Vthd, the current on the light emitting device OLED is independent of the threshold voltage Vthd of the thin film transistor serving as the driving unit.

Figure 9:
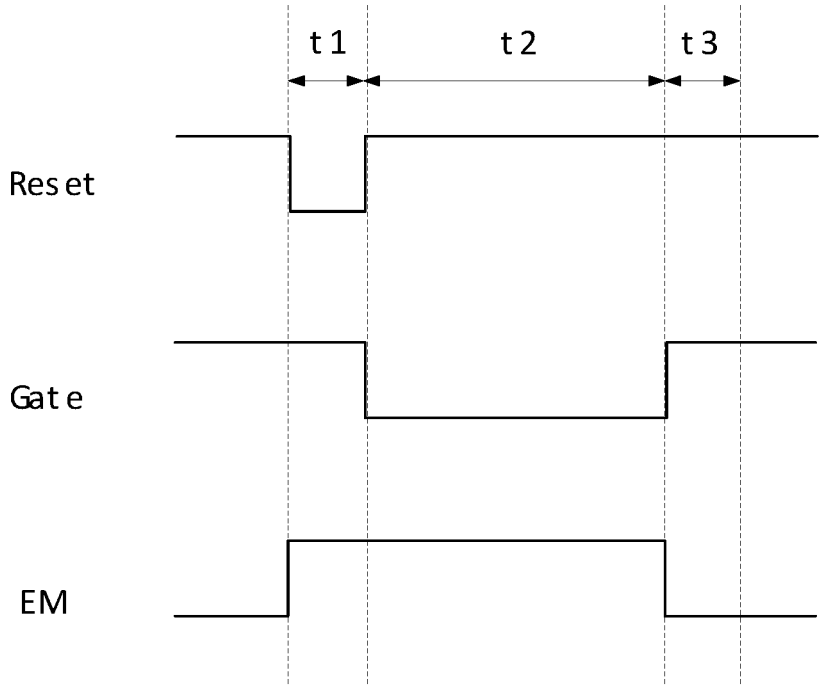
FIG. 9 shows a timing diagram of the input signals for a pixel driving circuit provided in an embodiment of the present disclosure.

Specifically, the operation principle of the pixel driving circuit provided in the embodiments of the disclosure will be described with reference to the circuit layout shown in FIG. 3 and the input signal timing for the pixel driving circuit shown in FIG. 9. Although P-type transistors are used in the pixel driving circuit shown in FIGS. 3 and 5, the type of the transistors can simply be changed with only a need to adjust the corresponding gate voltage. The type of individual thin film transistors is not limited in the embodiments of the present disclosure. Where the type of the individual thin film transistors is changed, it is only necessary to adjust the voltage signal applied to the gates of the thin film transistors in order for the driving method of the pixel circuit provided in the embodiments of the present disclosure to be implemented. Any combinations of the pixel driving circuit and the driving method that can be easily conceived and implemented, by one of ordinary skill in the art, based on those provided in the embodiments of the present disclosure, fall within the scope of the present disclosure.

At the first phase t1, the reset signal "Reset" is a low voltage, the source and the drain of the first switching unit T1 are brought into conduction, the storage capacitor Cst is charged with the initialization voltage Vint, the source and the drain of the fifth switching unit T5 are brought into conduction, the first terminal L1 of the light emitting device OLED is initialized by the initialization voltage Vint. At this time, the potential of the gate of the driving unit DTFT is the initialization voltage Vint.

At the second phase t2, the scan signal "Gate" is a low voltage, the source and the drain of the second switching unit T2 are brought into conduction, and the third switching unit T3 exhibits a diode state at this time. The storage capacitor Cst is charged by the data signal via the source and the gate of the third switching unit T3. In this case, the potential of the gate of the driving unit DTFT is the sum of the data signal voltage Vdata and the threshold voltage Vth3 of the third switching unit T3.

At the third phase t3, the light emitting signal EM is a low voltage, the source and the drain of the fourth switching unit T4 are brought into conduction, and the light emitting device OLED is driven by the driving unit DTFT. Since the threshold voltage of the driving unit DTFT has been compensated on the gate of the driving unit DTFT in the second phase, the driving current $I_{OLED}$ of the OLED is related to the data signal voltage Vdata while being independent from the threshold value of the driving unit DTFT, according to the above formula Similarly, the input signal timing of the pixel driving circuit shown in FIG. 9 may be applied to the circuit layout shown in FIG. 5, which is not described here for simplicity.

With the pixel driving circuit provided in the embodiments of the present disclosure, the sum of the data signal voltage and the threshold voltage of the third switching unit can be written into the control terminal of the driving unit before the light emitting device emits light, thereby eliminating the effect of the change in the threshold voltage of the driving unit on the light emission. Moreover, a circuit configuration can be achieved with a relatively small storage capacitor. Furthermore, the first terminal of the light emitting device can be initialized with the fifth switch unit so that a voltage across the light emitting device can be adjusted to, for example, zero before light emission. The leakage current generated by the driving unit may flow out through the first signal terminal of the fifth switching unit when a dark state display with lower gray scales is performed. Therefore, the leakage current does not flow to the light emitting device so that the light emitting device can accurately show the dark state, thereby increasing the display contrast. The embodiments of the present disclosure may implement a driving circuit by using one storage capacitor, one driving unit and five switching units, which may obtain a smaller pixel layout and contribute to improvement of the display resolution. Moreover, the display effect of the pixels in the dark state can be improved, and the contrast be increased.

It will be apparent to those skilled in the art that various modifications and variations can be made to this disclosure without departing from the spirit and scope of the present disclosure. Thus, the present disclosure is intended to encompass such modifications and variations if they fall within the scope of the present disclosure and equivalents thereof.

What is claimed is:

1. A pixel driving circuit comprising a light emitting device, a storage capacitor, a driving unit, and first to fifth switching units, each of the switching units comprising a control terminal, a first signal terminal and a second signal terminal, the control terminal of the switching unit being operable to bring the first and second signal terminals into or out of conduction, the driving unit comprising a control terminal, a signal input terminal and a drive terminal, the control terminal and the signal input terminal of the driving unit being operable to control a drive signal outputted at the drive terminal, the control terminal of the driving unit being connected with a first terminal of the storage capacitor, the first signal terminal of the first switching unit, the first signal terminal of the second switching unit and the control terminal of the third switching unit, the control terminal of the first switching unit being operable to input a reset signal, the second signal terminal of the first switching unit being connected with an initialization voltage, the control terminal of the second switching unit being operable to input a scan signal, the second signal terminal of the second switching unit being connected with the first signal terminal of the third switching unit, the second signal terminal of the third switching unit being operable to input a data signal, the control terminal of the fourth switching unit being operable to input a light emitting signal, the control terminal of the fifth switching unit being operable to input the reset signal, the first signal terminal of the fifth switching unit being connected with the initialization voltage, the second signal terminal of the fifth switching unit being connected with a first terminal of the light emitting device, wherein the signal input terminal of the driving unit is connected with a second terminal of the storage capacitor and a first voltage, the drive terminal of the driving unit is connected with the first signal terminal of the fourth switching unit, and the second signal terminal of the fourth switching unit is connected with the first terminal of the light emitting device, or wherein the first signal terminal of the fourth switching unit is connected with the second terminal of the storage capacitor and the first voltage, the second signal terminal of the fourth switching unit is connected with the signal input terminal of the driving unit, and the drive terminal of the driving unit is connected with the first terminal of the light emitting device, and wherein a second terminal of the light emitting device is connected with a second voltage.

2. The pixel driving circuit of claim 1, wherein the driving unit and the first to fifth switching units are thin film transistors, wherein:

the control terminal of each of the switching units and the control terminal of the driving unit are each a gate of the thin film transistor;

the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

3. The pixel driving circuit of claim 2, wherein the driving unit and the first to fifth switching units are P-type thin film transistors.

4. The pixel driving circuit of claim 2, wherein the driving unit and the first to fifth switching units are N-type thin film transistors.

5. The pixel driving circuit of claim 1, wherein the driving unit and the third switching unit are thin film transistors having the same specifications.

6. The pixel driving circuit of claim 1, wherein the light emitting device is an organic light emitting diode.

7. A display substrate comprising the pixel driving circuit of claim 1.

8. The display substrate of claim 7, wherein the driving unit and the first to fifth switching units are thin film transistors, wherein:

the control terminal of each of the switching units and the control terminal of the driving unit are each a gate of the thin film transistor;

the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

9. The display substrate of claim 8, wherein the driving unit and the first to fifth switching units are P-type thin film transistors.

10. The display substrate of claim 8, wherein the driving unit and the first to fifth switching units are N-type thin film transistors.

11. The display substrate of claim 7, wherein the driving unit and the third switching unit are thin film transistors having the same specifications.

12. The display substrate of claim 7, wherein the light emitting device is an organic light emitting diode.

13. A display apparatus comprising the pixel driving circuit of claim 1.

14. The display apparatus of claim 13, wherein the driving unit and the first to fifth switching units are thin film transistors, wherein:

the control terminal of each of the switching units and the control terminal of the driving unit are each a gate of the thin film transistor;

the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

15. The display apparatus of claim 14, wherein the driving unit and the first to fifth switching units are P-type thin film transistors.

16. The display apparatus of claim 14, wherein the driving unit and the first to fifth switching units are N-type thin film transistors.

17. The display apparatus of claim 13, wherein the driving unit and the third switching unit are thin film transistors having the same specifications.

18. The display apparatus of claim 13, wherein the light emitting device is an organic light emitting diode.

19. A driving method for the pixel driving circuit of claim 1, comprising:

at a first phase, bringing into conduction the first and second signal terminals of the first switching unit, charging the storage capacitor with the initialization voltage, bringing into conduction the first and second signal terminals of the fifth switching unit, and initializing the first terminal of the light emitting device with the initialization voltage;

at a second phase, bringing into conduction the first and second signal terminals of the second switching unit, and charging the storage capacitor with the data signal via the second signal terminal and the control terminal of the third switching unit; and at a third phase, bringing into conduction the first and second signal terminals of the fourth switching unit, and driving by the driving unit the light emitting device.

20. The driving method of claim 19, wherein the driving unit is a thin film transistor, and wherein, in the third phase, the thin film transistor serving as the driving unit is in a saturated state.

* * * * *